United States Patent [19]

Cross

[11] Patent Number: 4,653,754

[45] Date of Patent: Mar. 31, 1987

[54] BALL BAT HAVING GROOVED KNOB

[76] Inventor: William D. Cross, 419 Meadowview Dr., Blue Springs, Mo. 64015

[21] Appl. No.: 822,649

[22] Filed: Jan. 27, 1986

[51] Int. Cl.[4] ..... A63B 59/06

[52] U.S. Cl. ..... 273/72 R; 273/75

[58] Field of Search ..... 273/72 R, 75, 81 R, 273/81.4, 67 A, 81 B, 73 J, 81 D; D21/211

[56] References Cited

U.S. PATENT DOCUMENTS

| | | | |
|---|---|---|---|
| D. 119,261 | 3/1940 | Gurrieri | D21/211 |
| 1,638,454 | 8/1927 | Papin | 273/81.4 |
| 1,664,257 | 3/1928 | McCullough | 273/81 D |
| 2,031,161 | 2/1936 | Hamel | 273/72 |
| 2,752,455 | 12/1956 | Liberti | 273/72 R |
| 2,895,737 | 7/1959 | Blees | 273/26 |
| 3,084,938 | 4/1963 | Kapanowski | 273/81 D |
| 3,104,876 | 9/1963 | Salsinger | 273/72 R |
| 3,905,598 | 9/1975 | Ballog | 273/73 J |

FOREIGN PATENT DOCUMENTS

| | | | |
|---|---|---|---|
| 2704688 | 5/1952 | Australia | 273/81 B |

*Primary Examiner*—Richard C. Pinkham
*Assistant Examiner*—Gary Jackson
*Attorney, Agent, or Firm*—Schmidt, Johnson, Hovey & Williams

[57] ABSTRACT

An improved ball bat providing greater gripping comfort and batting power is provided by provision of a bat having a peripherally grooved lower terminal knob adapted to receive the small or little finger of a batter's hand. The bat construction may be used in softball or baseball bats formed of various materials such as wood or aluminum. The finger-receiving groove may extend in a continuous fashion around the entire periphery of the terminal knob, or only part way around the knob.

5 Claims, 6 Drawing Figures

BALL BAT HAVING GROOVED KNOB

BACKGROUND OF THE INVENTION

1. Field of the Invention

The present invention relates to improvements in softball or baseball bats which permit the batter to use the bat with greater comfort and ease, and with increased batting power. More particularly, it is concerned with such an improved ball bat which includes a grooved terminal knob designed to receive the little finger of the bottom hand of a batter.

2. Description of the Prior Art

Conventional bats used in baseball or softball generally include an elongated shank or handle portion of convenient diameter for gripping by a batter, with an enlarged, elongated, smoothly tapered ball-engaging portion extending from one end of the handle. Moreover, such bats typically include a relatively thin, smoothly arcuate, radially enlarged terminal knob at the lower end of the handle portion remote from the ball-engaging section of the bat.

Many batters, particularly those seeking to maximize their batting power, tend to grip a conventional bat at as low a position as possible on the handle. Indeed it is quite common to see batters position their lowermost batting hand with the little finger of that hand in overlapping relationship to the radially enlarged knob. While many batters feel that this aids in increasing the power of their batting stroke, placement of their bottom hands with one or more fingers overlapping the bat knob is inherently an uncomfortable batting position which may detract from desirable bat control.

Various modified ball bats and other sporting devices have been proposed in the past. For example, U.S. Pat. No. 2,775,455 to Liberti describes an ambidexterous bat provided with a pair of opposed grooves in the handle portion of the bat adjacent the terminal knob. These grooves are adapted to receive the small finger of a batter, and the patent teaches that the grooves are disposed for ensuring that the wood grain of the bat will at all times be in correct relationship to the anticipated point of impact between the bat and a pitched ball, regardless of whether a right or left handed batter is using the bat. It will be appreciated, of course, that the construction described in U.S. Pat. No. 2,775,455 does not solve the problem noted above, i.e., the inherently uncomfortable batting grip resulting when a batter attempts to place his small finger around the periphery of the terminal knob. Indeed, the Liberti construction actually exacerbates the problem, by in effect creating an excessive disparity between the radius of the bat handle adjacent the knob, and the periphery of the knob itself. In short, the structure described in the Liberti patent would create more severe problems to a batter wishing to place his hands as low as possible on the bat handle, as compared with conventional bats. Other prior art references describing various types of grips include U.S. Pat. Nos. 2,895,737, 3,084,938, 2,031,161, 1,664,257 and 1,638,454.

SUMMARY OF THE INVENTION

The problems outlined above are in large measure solved by the improved ball bat of the present invention. Broadly speaking, the bat hereof includes an elongated handle portion of a comfortable diameter for gripping by a batter, with an elongated, radially enlarged, ball-engaging portion extending from one end of the handle. The bat further includes a relatively thin terminal knob at the end of the handle portion remote from the ball-engaging portion, with the knob being radially enlarged relative to the handle portion. Advantageously, the knob is slightly thicker than most conventional knobs in order to accommodate a properly configured groove.

Additionally, however, the bat of the present invention includes structure defining an elongated groove in the periphery of the terminal knob for receiving the small or little finger of a batter. This groove may be continuous and extend completely around the periphery of the knob, or the groove can extend only part way around the knob periphery. Advantageously, the finger-receiving groove is arcuate in cross-section and presents smoothly rounded corners adjacent the top and bottom margins of the knob.

The improvement of the present invention can be utilized in virtually all types of ball bats, including those used for softball and baseball. Moreover, the bats of the present invention can be formed of wood or metal, e.g., aluminum.

DESCRIPTION OF THE PREFERRED EMBODIMENTS

Figure 1:
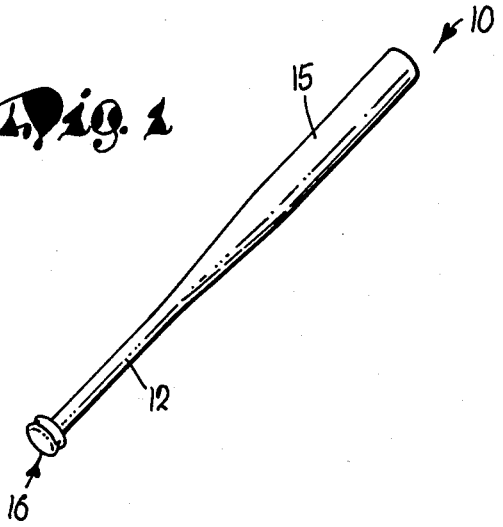
FIG. 1 is a perspective view of a ball bat in accordance with the present invention, illustrating the grooved terminal knob.
Figure 2:
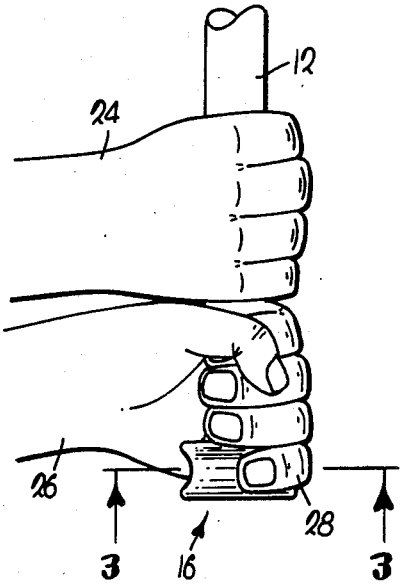
FIG. 2 is a fragmentary view illustrating the bat in accordance with the present invention, shown being gripped by a batter with the small or little finger of the batter's lower hand being received within the peripheral groove of the lower terminal knob.
Figure 3:
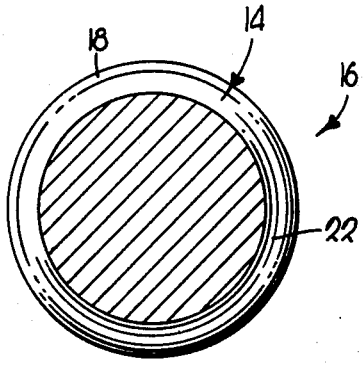
FIG. 3 is a sectional view taken along line 3—3 of FIG. 2 which further illustrates the grooved knob structure of the invention.
Figure 4:
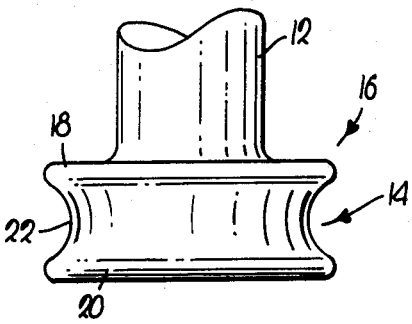
FIG. 4 is an enlarged, fragmentary view further depicting in detail the grooved knob structure.

Turning now to the drawing, a bat 10 in accordance with the invention is illustrated in perspective in FIG. 1. The bat 10 is of integral construction and includes an elongated gripping or handle portion 12 adjacent the lower end of the bat, with a radially enlarged, elongated ball-engaging portion 15 extending from one end of handle portion 12. In addition, the bat 10 includes a specialized terminal knob 16 at the end of handle portion 12 remote from the portion 15. As illustrated, the knob 16 is relatively thin and is radially enlarged relative to the adjacent handle portion 12. As best seen in FIGS. 2–4, the knob 16 is provided with an elongated, arcuate in cross-section groove 14 extending around the periphery of the radially enlarged knob. To this end, it will be observed (see FIG. 4), that the groove-defining structure presents upper and lower, smoothly rounded shoulders 18 and 20 connected by a shallow, arcuate, smoothly tapered wall 22.

Turning now to FIG. 2, it will be seen that in use a batter's hands 24, 26 can be placed along the lower section of handle portion 12, with the small or little finger 28 of the batter's lower hand 26 being received within the groove 14. In this way the batter may more comfortably grip the bat with a less pronounced dimensional variation between the handle portion 12 and the knob 16, as compared with conventional bats. An additional advantage of the present invention resides in the fact that use of the grooved knob 16 permits additional weight to be placed in the upper ball-engaging portion 14 of the bat. That is to say, total bat weight limits are strictly enforced in regulation bats for baseball and softball, and it is advantageous that the maximum amount of mass be present in the upper ball-engaging portion 14 of a bat in order to increase batting power. As such, removal of material from the bat in order to form the lower peripheral groove 14 in knob 16, permits an enlargement of the upper portion of the bat without violating total weight standards.

Figure 5:
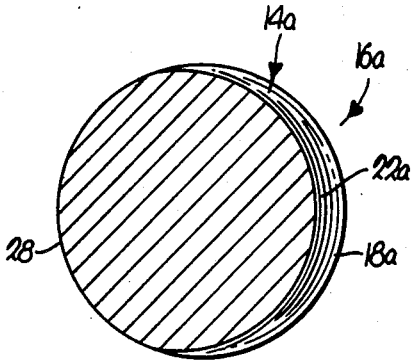
FIG. 5 is a sectional view similar to that of FIG. 3 which illustrates a second embodiment of the invention wherein the lower terminal knob includes a finger-receiving groove extending only part way around the periphery of the knob.
Figure 6:
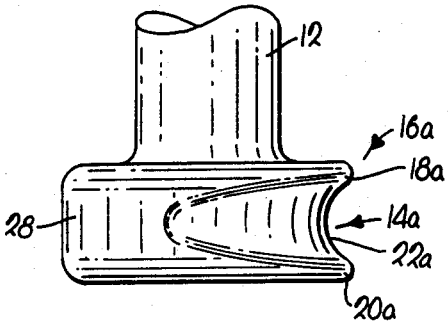
FIG. 6 is an enlarged fragmentary view similar to that of FIG. 4 showing in detail the grooved knob structure of the embodiment illustrated in FIG. 5.

FIGS. 5–6 depict another embodiment in accordance with the invention, wherein use is made of a terminal knob 16*a*. In this case, however, the peripheral groove 14*a* extends only partially around the periphery of the knob 16*a*, as opposed to the groove 14 of FIGS. 1–4, which extends in a continuous fashion around the knob periphery. Here again though, it will be observed that the groove 14*a* is configured to present upper and lower, smoothly rounded shoulders 18*a* and 20*a*, together with a smoothly tapered, interconnecting, groove-defining wall 22*a*. Further, it will be observed that the depth of the groove 14*a* smoothly tapers toward and merges with the normal outer peripheral wall 28 of the handle 16*a*. In the case of wooden bats in accordance with this embodiment, the finger-receiving groove is preferably formed with the longitudinal axis thereof essentially perpendicular to the grain of the wood, such grain normally being horizontally oriented when the knob is viewed in plan. Hence, the bats can be used by right or left handed batters while still maintaining the grain properly oriented for batting.

Those skilled in the art will readily appreciate that the present invention admits of many variations and alterations. Such would include use of various materials for forming the bat proper (e.g., wood or aluminum), as well as changes in the specific dimensions of the grooved terminal knob. It is, of course, intended that all such variations and alterations be included within the fair scope of the claims hereof.

I claim:

1. A ball bat, comprising:

an elongated handle portion presenting a smooth outer surface and a circular cross-section throughout the length thereof;

an elongated, radially enlarged ball-engaging portion extending from an end of the handle portion;

a terminal knob at the end of said handle portion remote from said ball-engaging portion and defining the butt end of said bat, said knob presenting a pair of axially spaced apart circular end walls respectively adjacent to and remote from said handle portion and coaxially aligned with the handle portion, and a peripheral wall joining said circular knob end walls, said knob-defining end walls having a diameter greater than the diameter of the section of said handle portion immediately adjacent said knob whereby the knob is radially enlarged relative to said section of said handle portion immediately adjacent said knob; and structure defining an elongated groove in the peripheral wall of said knob for receiving the little finger of a batter's hand gripping said handle portion, said finger-receiving groove presenting a concavity in said peripheral wall, said concavity having an innermost, central, arcuate in cross section wall portion leading to and adjoining said circular end walls and having a relatively long radius of curvature, the joinder between said central wall portion and said circular end walls being respective, convex, arcuate sections each having a relatively short radius of curvature, said relatively short radii of curvature being substantially smaller than said relatively long radius of curvature of said wall portion, said innermost wall portion being spaced both radially outwardly and axially from said section of said handle portion immediately adjacent said knob.

2. The bat of claim 1, said groove being continuous and extending completely around said knob periphery.

3. The bat of claim 1, said groove extending around only a portion of the knob periphery.

4. The bat of claim 1, said bat being formed of wood.

5. The bat of claim 1, said bat being formed of aluminum.

* * * * *